US009494062B1

(12) United States Patent
Warren

(10) Patent No.: US 9,494,062 B1
(45) Date of Patent: Nov. 15, 2016

(54) METHOD OF IMPROVING PISTON RING SEAL BY START-UP LUBRICATION

(71) Applicant: Leonard P. Warren, Seymour, TN (US)

(72) Inventor: Leonard P. Warren, Seymour, TN (US)

( * ) Notice: Subject to any disclaimer, the term of this patent is extended or adjusted under 35 U.S.C. 154(b) by 108 days.

(21) Appl. No.: 14/528,027

(22) Filed: Oct. 30, 2014

(51) Int. Cl.

| | |
|---|---|
| ***C10M 169/06*** | (2006.01) |
| ***F01M 1/00*** | (2006.01) |
| ***B23P 19/04*** | (2006.01) |
| ***C10M 125/26*** | (2006.01) |
| ***F01M 7/00*** | (2006.01) |

(52) U.S. Cl.
CPC ..... *F01M 1/00* (2013.01); *B23P 19/042* (2013.01); *C10M 125/26* (2013.01); *F01M 7/00* (2013.01)

(58) Field of Classification Search
CPC ..... F01M 1/00; F01M 7/00; C10M 125/26; B23P 19/042
See application file for complete search history.

(56) References Cited

U.S. PATENT DOCUMENTS

| | | | | |
|---|---|---|---|---|
| 1,987,105 | A * | 1/1935 | Hall | F01L 7/028 123/190.15 |
| 2,309,968 | A * | 2/1943 | Marburg | F02B 41/08 123/41.77 |
| 5,037,564 | A * | 8/1991 | Nishizaki | C09B 67/0086 508/450 |
| 6,390,682 | B1 | 5/2002 | McMeekin et al. | |
| 6,933,264 | B2 | 8/2005 | Petelot | |
| 6,960,555 | B2 | 11/2005 | Anthony et al. | |
| 7,091,161 | B2 | 8/2006 | Oldiges, Jr. et al. | |
| 7,294,608 | B2 | 11/2007 | Oldiges et al. | |
| 7,505,564 | B2 | 3/2009 | Anand et al. | |
| 7,510,760 | B2 | 3/2009 | Malshe et al. | |
| 9,206,377 | B1 * | 12/2015 | Warren | C10M 169/04 |
| 2003/0119681 | A1 * | 6/2003 | Patel | C10M 169/00 508/150 |
| 2004/0229760 | A1 | 11/2004 | Oldiges, Jr. | |
| 2008/0145554 | A1 | 6/2008 | Ghasripoor et al. | |
| 2008/0312111 | A1 | 12/2008 | Malshe | |
| 2010/0167968 | A1 | 7/2010 | Pinel et al. | |
| 2011/0285124 | A1 | 11/2011 | Pinel et al. | |

OTHER PUBLICATIONS

U.S. Appl. No. 13/775,573, filed Feb. 25, 2013, Warren.
U.S. Appl. No. 13/919,066, filed Jun. 17, 2013, Warren.
U.S. Appl. No. 14/068,250, filed Oct. 31, 2013, Warren.
U.S. Appl. No. 14/333,718, filed Jul. 17, 2014, Warren.
"The Effect of Counterface on the Tribological Performance of a High Temperature Solid Lubricant Composite . . . ", C Dellacorte, NASA Lewis Research Ctr Apr. 22-26 1996, 16 pgs.
"Solid Lubricants / Dry Lubrication", http: www.tribology-abc.com/abc/solidlub.htm, Nov. 14, 2012, 4 pgs.

* cited by examiner

*Primary Examiner* — Ryan J Walters
(74) *Attorney, Agent, or Firm* — Charles R. Wilson

(57) ABSTRACT

A method for ensuring a good ring seal is for use in assembling a new engine or rebuilding an engine. The method comprises in each aspect use of a start-up lubricating composition comprised of a powder blend of (a) molybdenum disulfide, tungsten disulfide or a mixture thereof, (b) boron nitride, and (c) an inorganic fluoride, all suspended in a carrier fluid.

14 Claims, No Drawings

METHOD OF IMPROVING PISTON RING SEAL BY START-UP LUBRICATION

This application claims the benefit of U.S. Provisional Application No. 61/897,936, filed Oct. 31, 2013.

FIELD OF THE INVENTION

This invention relates to a method of improving the seal of piston rings. More particularly, the invention relates to a method of assembling engines having pistons and associated rings in a factory, machine shop, professional racer or enthusiast shop, home garage, or the like whereby the piston ring seal of the engine is improved.

BACKGROUND OF THE INVENTION

Lubricating compositions are widely used in industrial and commercial applications. They are used whenever two or more solid surfaces move in close contact. Examples of the several uses include gasoline engines, diesel engines, and motors of all sorts. A critical feature of such lubricants is the ability to provide lubrication to an interface between rings and cylinder walls and also ring grooves in all the pistons. Ring lubrication is designed to initially provide a controlled wear between the ring's edge/face and the cylinder wall, creating a tight "seal" at the interface. This seal reduces contamination of the oil due to blow-by of hydrocarbon residue created during combustion, maintains maximum pressure in the combustion chamber during the power stroke, and reduces the potential for lubricating oil to be drawn into the combustion chamber during the intake stroke.

Lubrication is also needed between the top and bottom portions of the ring where it rides in the ring grooves of the piston. Thus, the ring is subject to loading in multiple directions during piston travel and lubrication is critical to the free movement of the ring, allowing the ring to maintain contact and seal with the cylinder wall.

The "seal" of an engine is normally determined by the percentage of leak-down that is experienced when the combustion chamber is filled with pressurized air and the rate of pressure drop is measured. This seal can be damaged if, during assembly of the engine, insufficient lubrication is present during an initial rotation of the crankshaft which causes piston movement within the cylinder. The cylinder wall and piston are normally lubricated with oil during engine assembly. However, such fluid runs off while the engine sits prior to its initial firing. The same condition occurs when an assembled engine has sat for an extended period of time. At start-up, the initial movement of the pistons within the cylinders which have minimal to no lubrication causes excessive wear and can even lead to the ring "grabbing" in the ring grooves due to the load experienced. Such conditions lead to poor ring seal and a resultant loss of power and degraded engine life.

The problem is that during the initial rotation of the crankshaft and piston movement, the only lubrication that reaches the critical area is from "splash" lubrication. This is because there is no pressurized delivery of oil to these areas. Consequently, multiple rotations occur before the rings and associated surfaces see any lubrication at all, let alone sufficient lubrication to provide what is needed for the "best" ring seal to occur.

There is a need to ensure that ring seal of an engine is optimum. That need has now been met by the method of this invention.

SUMMARY OF THE INVENTION

In the method of this invention, a start-up lubricating composition is applied directly or indirectly to piston rings mounted on a piston. For new engine assembly, it can be applied directly to the rings once they are mounted in their piston grooves and prior to each piston with its piston rings being installed in an engine's cylinder. The composition can also be first applied to an outer edge of the piston after installation in a cylinder, directly above the top ring. Air is then used to force the lubricating composition down to the top ring. The crankshaft is lastly rotated at least once, mechanically or manually with no ignition occurring. This is sufficient to spread the lubricating composition over the critical areas. For a fully assembled engine, the start-up lubricating composition is first squirted into the combustion chamber via a small tube inserted through a spark plug hole and then pressurized air is used to force the lubricating composition down to the top ring. Finally, the crankshaft is rotated to spread the lubricating composition on the cylinder wall and onto the other ring assemblies on the pistons.

DETAILED DESCRIPTION OF THE INVENTION

The method of the invention comprises a series of steps, all for the purpose of ensuring a good piston ring seal in an internal combustion engine. The method is apropos for use when the engine is first assembled in a factory and also for use when an assembled engine is rebuilt in a commercial or home garage. The method is of benefit for any engine of any cylinder count. It includes a single cylinder motorcycle engine, a two cylinder industrial engine, and multi-cylinder engines. Unless otherwise stated, all percentages and ratios are in weight.

The start-up lubricating composition used in the method of the invention is specially formulated. It has a consistency such that it cannot drip or run off prior to the engine being fired. In addition, it contains special lubrication components that bond to the rings and related surfaces at pressures/loads and temperatures where wear or sticking would be encountered.

A series of steps is performed as described in detail. In all instances, the start-up lubricating composition specially formulated for the method of the invention is used as described in detail below and is critical to achieving objectives of the method.

The start-up lubricating composition used in the method comprises a heavy bodied fluid which is a three component powder blend and a carrier fluid. In particular, the start-up lubricating composition comprises (1) from about 25% to about 60% of molybdenum disulfide, tungsten disulfide or a mixture thereof, (2) from about 0.5% to about 5% of boron nitride, 0) about 0.8% to about 6% of an inorganic fluoride and the balance a carrier fluid. The resultant fluid composition is heavy bodied, yet still fluid. A dynamic viscosity of about 2 Pascal-sec to about 90 Pascal-sec is satisfactory.

Examples of an inorganic fluoride used in the above composition include calcium fluoride, barium fluoride, lithium fluoride, magnesium fluoride, lanthium fluoride and mixtures thereof. Calcium fluoride is highly preferred because of availability and cost.

Carrier fluids which are used with the three component powder blend are organic. They include refined mineral oil and synthetic oil. Specifically, polyalphaolefins, polyolmonoesters and polyolmultiesters are examples of preferred carrier fluids.

A preferred start-up lubricating composition comprises (1) about 23% to about 50% of the molybdenum disulfide, tungsten disulfide or a mixture thereof, (2) about 1 to about 2% of the boron nitride, (3) about 2% to about 4% of the inorganic fluoride, and (4) about 45% to about 70% of the organic carrier fluid.

Other compatible components can be included in the start-up lubricating composition. Examples are other lubricants such as graphite and polytetrafluoroethylene (PTFE).

The method of the invention requires that the start-up lubricating composition be applied directly or indirectly to at least the top, i.e. upper ring after being mounted in a piston groove extending around the piston. Normally, a piston has three rings or less commonly two rings. The method further requires that the application of the start-up lubricating composition occur prior to ignition in the piston's combustion chamber. In the method's simplest form, the lubrication composition is applied directly to the ring(s) prior to the piston and its associated rings being installed in one of an engine's cylinders. Any fluid application means can be used, e.g. brushing, wiping, spraying, etc.

Alternative methods the invention relate to those instances when each piston with its associated piston rings are already installed in cylinders in the engine. It is required that the start-up lubricating composition be applied indirectly to at least the top ring. This is accomplished by introducing the lubricating composition into each cylinder of the engine prior to the engine's initial start-up. The manner of the composition's introduction depends on whether a new engine is being built or whether an assembled engine is being rebuilt.

For a new engine, the start-up lubricating composition is added to the top of each cylinder of the engine since the cylinder tops are accessible. An effective amount, e.g. about 1 gram to about 20 grams of the start-up lubricating competition is added to a top of the cylinder and then preferably pressurized gas introduced into the cylinder to force the lubricating composition down into contact with at least the top ring. The pressurized gas is preferably air at a pressure of about 5 psi to about 10 psi. It is applied until a major portion of the composition is over the top edge of the piston and down into the cylinder. While less preferred, the start-up lubricating composition once added to the top of a cylinder can be mechanically forced down to the piston's top ring. For example, a stiff brush can be used. The crankshaft in either case is now rotated at least one full rotation, preferably 1 to 5 rotations without engine ignition. The crankshaft can be manually rotated or mechanically rotated.

For an assembled engine which is being rebuilt, direct access to the engine's cylinders may not be possible. It is necessary that the effective amount of start-up lubricating composition be squirted through the engine's spark plug hole and into the cylinder's combustion chamber. Then the pressurized gas is introduced to force the lubricating composition to a ring. In this method, a pressurized gas of about 50 psi to about 100 psi is used for, typically, about 10 seconds. Finally, the engine's crankshaft is rotated at least once, preferably 1 to 5 rotations, again without engine ignition.

The improved seal provided in the method is due to several factors. One of the characteristics of the molybdenum and titanium disulfides is that each is attracted to heat, such as created by friction. In addition, each is a "sticky" material which maintains adhesion on parts beyond the level of conventional oils. This "sticky" nature allows them to hold the other critical ingredients in place while motion occurs. This is during the period of time when normal engine oil lubrication is nonexistent or minimal.

As apparent, the start-up lubricating composition is formulated for addition to an engine's piston and cylinder prior to firing of a new engine or a rebuilt engine. The basic idea is to have the start-up lubricating composition "in place" before potential permanent damage can occur due to inadequate normal engine lubrication.

It is during the initial start-up cycle that friction can damage the ring/cylinder wall wear leading to a poor seal. Initial heat is significant, in fact, many times beyond the temperatures that molybdenum or tungsten disulfide can effectively act as a lubricant. Inclusion of the boron nitride in the composition is needed since it is capable of lubricating at temperatures well beyond that of the disulfides. The friction generated by such motion can easily reach temperatures at which galling or micro welding can occur. This typically occurs at temperatures above that at which molybdenum disulfide and the other similar lubricants can provide protection. Boron nitride is capable of bridging this gap in lubrication until the inorganic fluoride begins to function.

The inorganic fluoride will form a self-lubricating ceramic film when sufficient temperature and pressure are experienced to cause it to soften and smear. The point at which it softens is well below its melting point. It should be understood that wear points are only small areas of the rang surface. Therefore, a small amount of the inorganic fluoride material that will not rub off is adequate. It will lubricate at low and high temperatures and pressures. It can, at a level just short of the point at which micro welding occurs, form a self-lubricating ceramic film. When this film forms, friction is immediately reduced eliminating or significantly reducing the potential for damaging wear or micro welding. In effect, the three lubricant component classes in the start-up lubrication composition provide their lubricating functions under different conditions.

The functions of the start-up lubricating composition components can even improve the seal when an old engine initially experiences wear. The lubricating characteristics of the method are such that a more normal wear pattern is generated when the engine is again started.

The following examples illustrate several suitable start-up lubricating compositions used in the method.

The following Examples 1-7 are examples of solid lubricant powder blends used to formulate the start-up lubricating compositions of the invention.

| | | |
|---|---|---|
| Example 1 | | |
| Tungsten Disulfide | 411 grams | 90.5% |
| Molybdenum Disulfide | 23 grams | 5.1% |
| Boron Nitride | 10 grams | 2.2% |
| Calcium Fluoride | 10 grams | 2.2% |
| | | 100.0% |
| Example 2 | | |
| Tungsten Disulfide | 410 grams | 90.3% |
| Boron Nitride | 10 grams | 2.2% |
| Calcium Fluoride | 34 grams | 7.5% |
| | | 100.0% |
| Example 3 | | |
| Tungsten Disulfide | 381 grams | 83.9% |
| Boron Nitride | 10 grams | 2.2% |
| Calcium Fluoride | 63 grams | 13.9% |
| | | 100.0% |

-continued

| Example 4 | | |
|---|---|---|
| Tungsten Disulfide | 371 grams | 81.7% |
| Molybdenum Disulfide | 23 grams | 5.1% |
| Boron Nitride | 10 grams | 2.2% |
| Calcium Fluoride | 50 grams | 11.0% |
| | | 100.0% |

| Example 5 | | |
|---|---|---|
| Tungsten Disulfide | 371 grams | 81.7% |
| Boron Nitride | 10 grams | 2.2% |
| Calcium Fluoride | 73 grams | 16.1% |
| | | 100.0% |

| Example 6 | | |
|---|---|---|
| Tungsten Disulfide | 361 grams | 79.5% |
| PTFE | 10 grams | 2.2% |
| Boron Nitride | 10 grams | 2.2% |
| Calcium Fluoride | 73 grams | 16.1% |
| | | 100.0% |

| Example 7 | | |
|---|---|---|
| Molybdenum Disulfide | 370 grams | 81.5% |
| Tungsten Disulfide | 24 grams | 5.3% |
| Graphite | 20 grams | 4.4% |
| Boron Nitride | 10 grams | 2.2% |
| Calcium Fluoride | 30 grams | 6.6% |
| | | 100.0% |

The following Examples 8-10 are examples of start-up lubricating compositions used in the method of the invention.

| Example 8 | | |
|---|---|---|
| Tungsten Disulfide | 411 grams | 36.2% |
| Molybdenum Disulfide | 23 grams | 2.0% |
| Boron Nitride | 10 grams | 0.9% |
| Calcium Fluoride | 10 grams | 0.9% |
| Polyalphaolefin | 681 grams | 60.0% |
| | | 100.0% |

| Example 9 | | |
|---|---|---|
| Tungsten Disulfide | 410 grams | 24.6% |
| Boron Nitride | 10 grams | 0.6% |
| Calcium Fluoride | 34 grams | 2.1% |
| Synthetic Oil | 1211 grams | 72.7% |
| | | 100.0% |

| Example 10 | | |
|---|---|---|
| Tungsten Disulfide | 410 grams | 45.2% |
| Boron Nitride | 10 grams | 1.1% |
| Calcium Fluoride | 34 grams | 3.7% |
| Refined Mineral Oil | 454 grams | 50.0% |
| | | 100.0% |

The following Example 11 illustrates a method of the invention.

Example 11

The start-up lubricating composition of Example 9 is used as a part of building a new engine in a factory. Each piston with new piston rings has been forced down into a cylinder using well known procedures and the engine's crankshaft has been connected to all piston rods. At this point, the engine's head has not been added, thereby allowing access to tops of the cylinder. About 2 grams of the start-up composition is poured onto the top of each cylinder. Next, 5 psi air is applied to the cylinder tops until a major part of the composition in each cylinder is found over the top. This is sufficient to force the lubricating composition to the top ring of each piston. One manual rotation of the crankcase is next made.

Having described the invention in its preferred embodiment, it should be clear that modifications can be made without departing from the spirit of the invention. It is not intended that the words used to describe the invention be limiting on the invention. It is intended that the invention only be limited by the scope of the appended claims.

I claim:

1. A method of preventing ring seal impairment of an internal combustion engine, said engine having at least one cylinder with an operatively associated piston positioned therewithin with each piston having at least two piston ring grooves extending therearound and a piston ring mounted in each piston ring groove, whereby motion from piston movement in the cylinder is transmitted to a crankshaft, comprising the steps of:

(a) applying a start-up lubricating composition to a top piston ring of each piston of the engine, wherein the start-up lubricating composition consists essentially of (1) from about 25% to about 60% molybdenum disulfide, tungsten disulfide, or a mixture thereof, (2) from about 0.5% to about 5% boron nitride, (3) from about 0.8% to about 6% inorganic fluoride, and (4) the balance a carrier fluid; and (b) rotating the crankshaft at least one rotation, whereby a film of the start-up lubrication is spread substantially evenly over each piston ring and cylinder wall thereby preventing ring seal impairment during subsequent powered rotations of the crankshaft for achieving lessened power loss and greater engine life.

2. The method of claim 1 wherein the crankshaft is rotated from 1 to 5 rotations.

3. The method of claim 2 wherein the crankshaft is manually rotated one full rotation.

4. The method of claim 3 wherein the start-up lubricating composition consists essentially of (1) from about 25% to about 50% of the molybdenum disulfide, tungsten disulfide or mixture thereof, (2) from about 1% to about 2% of the boron nitride, (3) from about 2% to about 4% of the inorganic fluoride, and (4) from about 45% to about 70% of the carrier fluid.

5. The method of claim 4 wherein the inorganic fluoride is calcium fluoride.

6. The method of claim 4 wherein the start-up lubricating composition is applied to each piston ring mounted in the piston grooves prior to each said piston being installed into a cylinder of the engine.

7. The method of claim 4 wherein the engine is a new engine.

8. The method of claim 4 wherein the engine is a rebuilt engine.

9. A method of preventing ring seal impairment during initial start-up of a new or rebuilt internal combustion engine prior to fully assembling the engine, said engine having at least one cylinder with an operatively associated piston positioned within each cylinder, each said piston having at least two piston ring grooves extending therearound and a piston ring mounted in each piston ring groove whereby motion from piston movement in the cylinder is transmitted to a crankshaft, comprising the steps of:

(a) adding a start-up lubricating composition to a top of each cylinder of the engine, wherein the start-up composition consists essentially of (1) from about 25% to about 60% molybdenum disulfide, tungsten disulfide, or a mixture thereof, (2) from about 0.5% to about 5% boron nitride, (3) from about 0.8% to about 6% inorganic fluoride, and (4) the balance a carrier fluid;

(b) introducing a pressurized gas to a top of each cylinder for forcing the start-up lubricating composition to the at least a top piston ring in the cylinder; and (c) rotating the crankshaft at least one rotation, whereby a film of the start-up lubricating composition is spread substantially evenly over each piston ring and cylinder wall thereby preventing ring seal impairment during subsequent rotations of the crankshaft for achieving lessened power loss and greater engine life.

10. The method of claim 9 wherein the crankshaft is rotated from 1 to 5 rotations.

11. The method of claim 10 wherein the inorganic fluoride is calcium fluoride.

12. The method of claim 11 wherein the pressurized gas has a pressure of about 5 psi to about 10 psi is used to force the start-up lubricating composition to the top piston ring of each piston.

13. A method of preventing ring seal impairment during initial start-up of a new or rebuilt internal combustion engine subsequent to fully assembling the engine, said engine having at least one cylinder with an operatively associated piston positioned within each cylinder, each said piston having at least two piston ring grooves extending therearound and a piston ring mounted in each piston ring groove whereby motion from piston movement in the cylinder is transmitted to a crankshaft, comprising the steps of:

(a) adding a start-up lubricating composition to a top of each cylinder of the engine by introducing it into the combustion chamber of said cylinder, wherein the start-up composition consists essentially of (1) from about 25% to about 60% molybdenum disulfide, tungsten disulfide, or a mixture thereof, (2) from about 0.5% to about 5% boron nitride, (3) from about 0.8% to about 6% inorganic fluoride, and (4) the balance a carrier fluid;

(b) introducing a pressurized gas to the top of each cylinder for forcing the start-up lubricating composition to at least a top piston ring in the cylinder; and (c) rotating the crankshaft at least one rotation, whereby a film of the start-up lubricating composition is spread substantially evenly over each piston ring and cylinder wall thereby preventing ring seal impairment during subsequent rotations of the crankshaft for achieving lessened power loss and greater engine life.

14. The method of claim 13 wherein the pressurized gas has a pressure of about 50 psi to about 100 psi.

* * * * *